US007784929B2

(12) United States Patent
Yamashita et al.

(10) Patent No.: US 7,784,929 B2
(45) Date of Patent: Aug. 31, 2010

(54) DROPLET EJECTING APPARATUS, A DROPLET ADHERENCE PREVENTING METHOD AND A CLEANING METHOD FOR CLEANING A RECORDING MEDIUM CARRIER ROLLER

(75) Inventors: Kunichi Yamashita, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 732 days.

(21) Appl. No.: 11/504,456

(22) Filed: Aug. 15, 2006

(65) Prior Publication Data

US 2007/0195145 A1 Aug. 23, 2007

(30) Foreign Application Priority Data

Feb. 23, 2006 (JP) ..... 2006-047389

(51) Int. Cl.
*B41J 2/01* (2006.01)

(52) U.S. Cl. ..... 347/101; 347/103

(58) Field of Classification Search ..... 347/84, 347/85, 101; 399/327
See application file for complete search history.

(56) References Cited

U.S. PATENT DOCUMENTS 6,820,975 B2 * 11/2004 Sugaya et al. ..... 347/104
2004/0091276 A1 * 5/2004 Yoshida et al. ..... 399/38
2004/0189773 A1 9/2004 Masumi et al.

FOREIGN PATENT DOCUMENTS

| | | |
|---|---|---|
| JP | 07-137903 | 5/1995 |
| JP | 11-208065 | 8/1999 |
| JP | 2003-089966 | 3/2003 |
| JP | 2004-123358 | 4/2004 |
| JP | 2004-276436 | 10/2004 |
| JP | 2004-306589 | 11/2004 |
| JP | 2004-338234 | 12/2004 |
| JP | 2005-178251 | 7/2005 |

OTHER PUBLICATIONS

J.T. Baker, 2003, Material Safety Data Sheet for Zinc Stearate, p. 1.*

* cited by examiner

*Primary Examiner*—Matthew Luu
*Assistant Examiner*—Kendrick X Liu
(74) *Attorney, Agent, or Firm*—Fildes & Outland, P.C.

(57) ABSTRACT

Droplet ejecting apparatus has a recording medium carrier portion provided with recording medium carrier rollers conveying a recording medium, a droplet ejecting portion discharging droplets to the recording medium, and a droplet adherence preventing liquid applying portion applying droplet adherence preventing liquid preventing adherence of the droplets to at least one of the recording medium carrier rollers.

5 Claims, 6 Drawing Sheets

32
32A
32
32B
32
32
32

DROPLET EJECTING APPARATUS, A DROPLET ADHERENCE PREVENTING METHOD AND A CLEANING METHOD FOR CLEANING A RECORDING MEDIUM CARRIER ROLLER

BACKGROUND OF THE INVENTION

1. Technical Field

The present invention relates to droplet ejecting apparatus, a droplet adherence preventing method, and a cleaning method for cleaning a recording medium carrier roller.

2. Description of the Related Art

An ink jet printer is generally provided with one or plural ink jet heads discharging ink droplets onto paper conveyed in a predetermined direction so as to print, and carrier rollers conveying the paper printed with an image out of the ink jet head.

When high-speed printing is performed by such an ink jet printer, the paper is conveyed out of the ink jet head by the carrier rollers before the ink discharged on the paper is sufficiently dried or fixed. Accordingly, there is a problem that an imaged formed on the paper smudges by ink being transferred from the paper to the image-side roller of the carrier rollers that contacts with the image surface of the paper, or by retransfer of ink adhered onto the carrier rollers back onto the paper.

Particularly, in ink jet printers having a paper-reversing double side-printing mechanism, in which paper is reversed after printing an image on one side thereof and then another image is printed on the opposite side thereof, since the carrier rollers also function as paper reversing rollers reversing the paper, a nip pressure at the carrier rollers is higher. Accordingly, a serious problem of ink contamination being generated and accumulated on the image-side roller occurs.

In order to solve the above problem, it has been proposed to provide a cleaning device cleaning the surface of the carrier rollers.

However, the proposed cleaning device only includes cleaning members such as a piece of non-woven cloth, felt, or sand paper that are pressed onto the carrier roller or carrier belt conveying printed paper so as to mechanically remove ink adhering to the surface thereof.

Accordingly, since the removed ink is accumulated in the cleaning member after prolonged use, the cleaning performance of the cleaning member can not be preserved for a long time.

SUMMARY OF THE INVENTION

According to an aspect of the present invention, there is provided a droplet ejecting apparatus including: a recording medium carrier portion provided with recording medium carrier rollers and conveying a recording medium; a droplet ejecting portion discharging droplets onto the recording medium; and a droplet adherence preventing liquid applying portion applying droplet adherence preventing liquid that prevents the droplets from adhering to at least one of the recording medium carrier rollers.

DESCRIPTION OF THE PREFERRED EMBODIMENTS

1. Embodiment 1

A description will be given below of an example of an ink jet recording apparatus including a droplet ejecting apparatus of the present invention.

Figure 1:
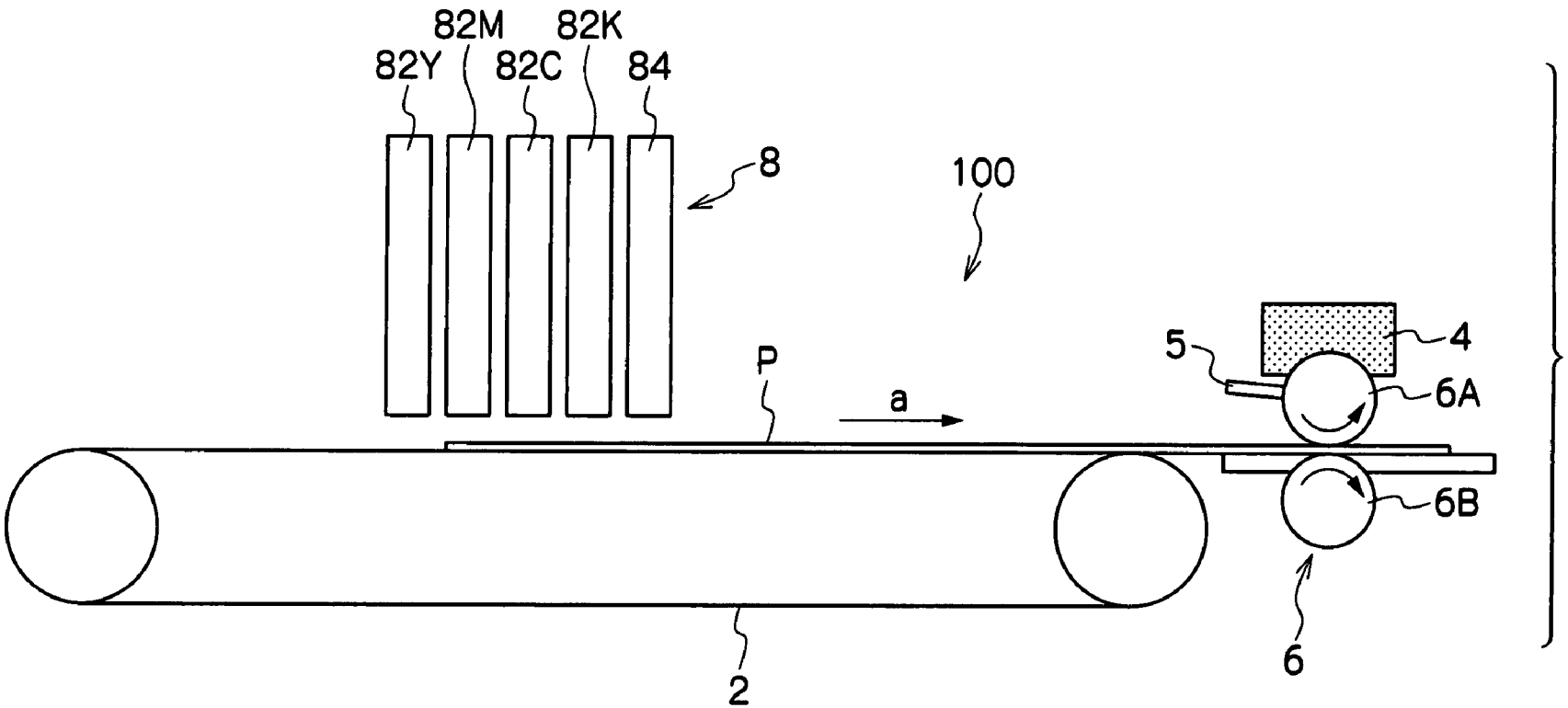
FIG. 1 is a schematic view showing a structure of an ink jet recording apparatus of a first embodiment.

As shown in FIG. 1, an ink jet recording apparatus 100 according to the first embodiment is provided with a carrier conveyor 2 feeding a sheet of paper P along a direction of an arrow 'a', a recording head array 8 discharging ink droplets onto the paper P conveyed on the carrier conveyor 2 so as to form an image, and a pair of paper carrier rollers 6 positioned at a downstream side of the carrier conveyor 2 with respect to the conveyance direction 'a' of the paper P and leading the paper P, on which the image is formed on an upper surface by the recording head array 8, in the conveyance direction 'a' out of the ink jet recording apparatus 100. The recording head array 8, the paper carrier rollers 6 and the paper P respectively correspond to the droplet ejecting portion, the recording medium carrier rollers and the recording medium in the present invention.

The recording head array 8 is provided with an ink jet head 82Y discharging yellow (Y) ink droplets, an ink jet head 82M discharging magenta (M) ink droplets, an ink jet head 82C discharging cyan (C) ink droplets, an ink jet head 82B discharging black (B) ink droplets, and a processing solution head 84 discharging processing solution droplets. All of the ink jet head 82Y, ink jet head 82M, the ink jet head 82C, the ink jet head 82B and the processing solution head 84 are so-called full-width heads, provided across the entire width of the paper P, and arranged from an upstream side to a downstream side in the conveyance direction 'a' of the paper P. The processing solution discharged from the processing solution head 84 includes a solution for making dyes or pigments in the Y, M, C and B inks, discharged from the ink jet head 82Y, the ink jet head 82M, the ink jet head 82C and the ink jet head 82B, insoluble so as to fix onto the paper P. Specifically, the solution includes an inorganic electrolyte, an organic amine compound, an organic acid or the like.

The paper carrier rollers 6 include an image side roller 6A that contacts with an upper surface that is the surface of the paper P to which the ink droplets discharged from the ink jet heads 82Y to 82B adhere, and a backside roller 6B positioned nipping at the opposite side of a conveyance path of the paper P to the image side roller 6A. The image side roller 6A and the backside roller 6B are nipped together at a predetermined pressure between these two rollers so that the paper P does not slip. The image side roller 6A and the backside roller 6B also rotate in directions opposite to each other, so that the sides thereof contacting with the paper P move in the same direction as the conveyance direction 'a' and at the same velocity.

A wick 4 impregnated with a anti-contamination liquid contacts with the image side roller 6A at a side opposite to the side that contacts with the paper P, and a leading edge of a surplus anti-contamination liquid removing blade 5 contacts with the image side roller 6A at a portion downstream from the portion with which the wick 4 contacts with respect to the rotation direction of the image side roller 6A. The wick 4 corresponds to the droplet adherence preventing liquid applying portion in the liquid discharge apparatus of the present invention. The wick 4 includes a porous material such as unwoven fabric, cloth, felt, sponge or the like shaped into a rectangular block.

The anti-contamination liquid which can be impregnated in the wick 4 corresponds to droplet adherence preventing liquid in the present invention, and generally includes a release agent or the like. Materials having a molecular weight of about 1,000 or less such as a polyethylene glycol, a polypropylene glycol, a polyethylene glycol-polypropylene glycol copolymer, an ethylene oxide-propylene oxide copolymer, a metal soap such as an aluminum soap, a magnesium soap, a zinc soap or the like, a higher fatty acid amide, a higher alcohol guide material, a silicone oil, a polypropylene wax, a mixture of a poly (methyl methacrylate) micro spheres and a polyvinyl fluoride or the like can be mentioned as examples of the anti-contamination liquid. They may be used independently, or can be used as a water and/or organic solvent solution. Additionally, a material that is a solid at an ambient temperature can be heated by a heater to be melted before usage so as to improve the coating property thereof to the image-side roller 6A.

As shown in FIG. 1, the wick 4 can be impregnated beforehand with a predetermined amount of anti-contamination liquid, or can be supplied externally with the anti-contamination liquid so as to be wetted therewith.

Figure 2:
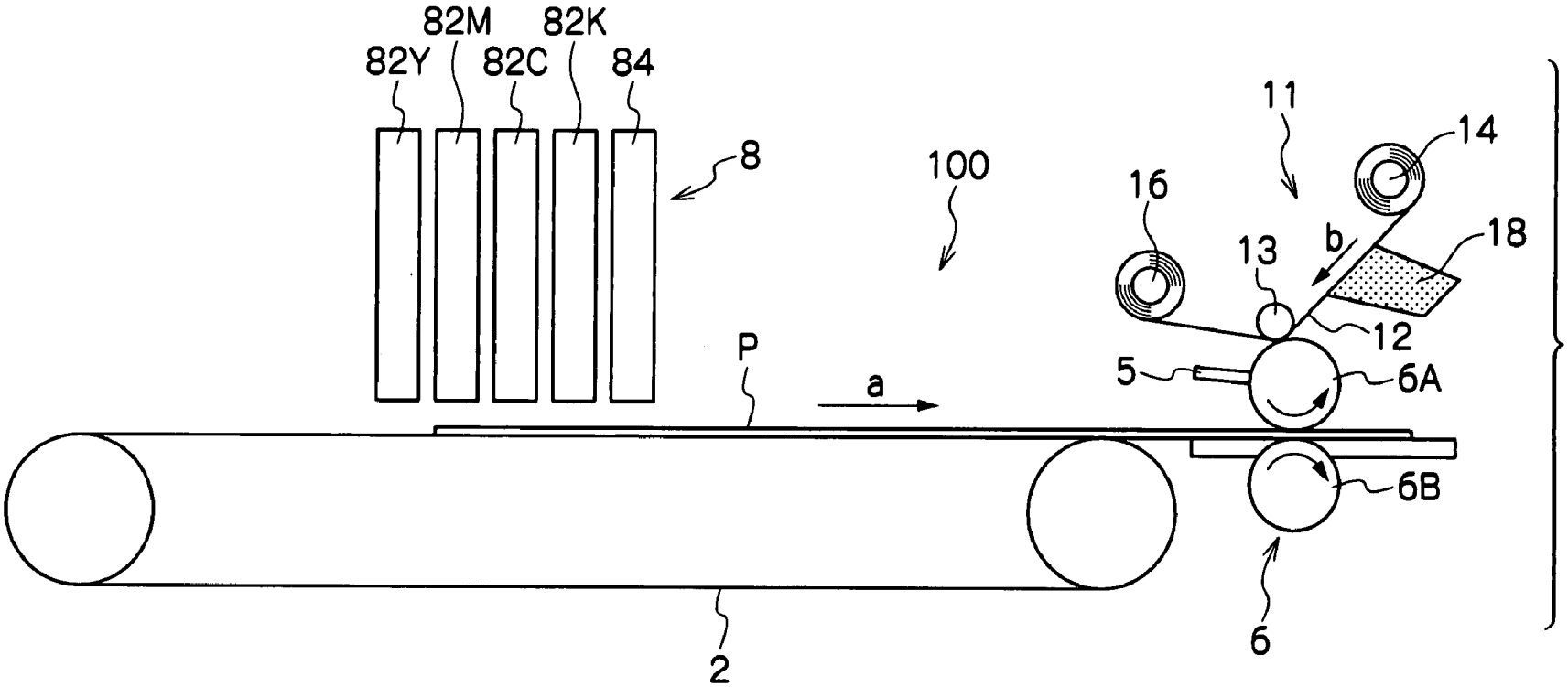
FIG. 2 is a schematic view showing a structure of another example of the ink jet recording apparatus according to the first embodiment.

In the ink jet recording apparatus 100, instead of bringing the wick 4 into contact with the image side roller 6A directly a web driving mechanism 11, in which the anti-contamination liquid is applied to the image side roller 6A by contacting a web formed of a porous material such as an unwoven fabric, cloth, felt, or sponge, or plastic film driven in a direction of an arrow 'b', can be provided close to the image side roller 6A, as shown in FIG. 2.

As shown in FIG. 2, the web driving mechanism 11 is provided with an unwinding roll 14 unwinding a web 12, a take-up roll 16 taking up the web 12 unwound from the unwinding roll 14 and making it travel in a direction of the arrow 'b', a pressing roller 13 pressing the web 12 to the image side roller 6A, and a wick 18 positioned in an upstream side from the image side roller 6A with respect to the traveling direction 'b' of the web 12 and brought into contact with a surface of the web 12 that contacts with the image side roller 6A. The wick 18 has the same structure as the wick 4, and is impregnated with the anti-contamination liquid. The wick 18 can include a disposable type wick that is impregnated beforehand with a predetermined amount of anti-contamination liquid and is discarded when the impregnated anti-contamination liquid is consumed up, or a reusable type wick that is supplied with the anti-contamination liquid by an appropriate means so as to be kept soaked the anti-contamination liquid.

The operation of the ink jet recording apparatus 100 is mentioned below.

When the paper P is conveyed with respect to the conveyance direction 'a' by the carrier conveyor 2 and passes under the recording head array 8, a predetermined image is formed on an upper surface of the paper P by the Y, M, C and B ink droplets discharged from the ink jet heads 82Y to 82B. The image formed on the upper surface of the paper P is made insoluble and fixed by the processing solution discharged from the processing solution head 84.

The paper P on which the image is fixed by the processing solution head 84 is conveyed out of the ink jet recording apparatus 100 by the carrier rollers 6, and the image formed on the paper P is brought into contact with the image side roller 6A.

Here, the anti-contamination liquid is applied to the image side roller 6A by the wick 4. Further, in the embodiment shown in FIG. 2, the anti-contamination liquid impregnated in the wick 18 is applied to the web 12 unwound from the unwinding roll 14. The side of the web 12 to which the anti-contamination liquid is applied is pressed against the image side roller 6A by the pressing roller 13 so that the anti-contamination liquid on the web 12 is transferred to the image side roller 6A. Thus, the anti-contamination liquid is applied to the image side roller 6A. The anti-contamination liquid can be applied at a time when a predetermined number of sheets of the paper P have been conveyed or when a predetermined time has passed. A device for detecting contamination on an image on the paper P or the image side roller 6A can be disposed and application of the anti-contamination liquid can be performed at a time when predetermined amount of contamination is detected on the image or the image side roller 6A.

Accordingly, even when the paper is conveyed by the carrier rollers 6 before the image formed on the paper P is completely fixed, as when performing high speed printing, contamination of the image on the paper P by wet ink adhering to the image side roller 6A can be prevented.

Further, in the embodiment shown in FIG. 2, since the wick 18 is not directly brought into contact with the image side roller 6A, the wick 18 is not contaminated by the ink even when wet ink adheres to the image side roller 6A. Therefore, the wick 18 has a longer service life in comparison to the wick 4.

2. Embodiment 2

Another example of an ink jet recording apparatus included in the droplet ejecting apparatus of the present invention is described below.

Figure 3:
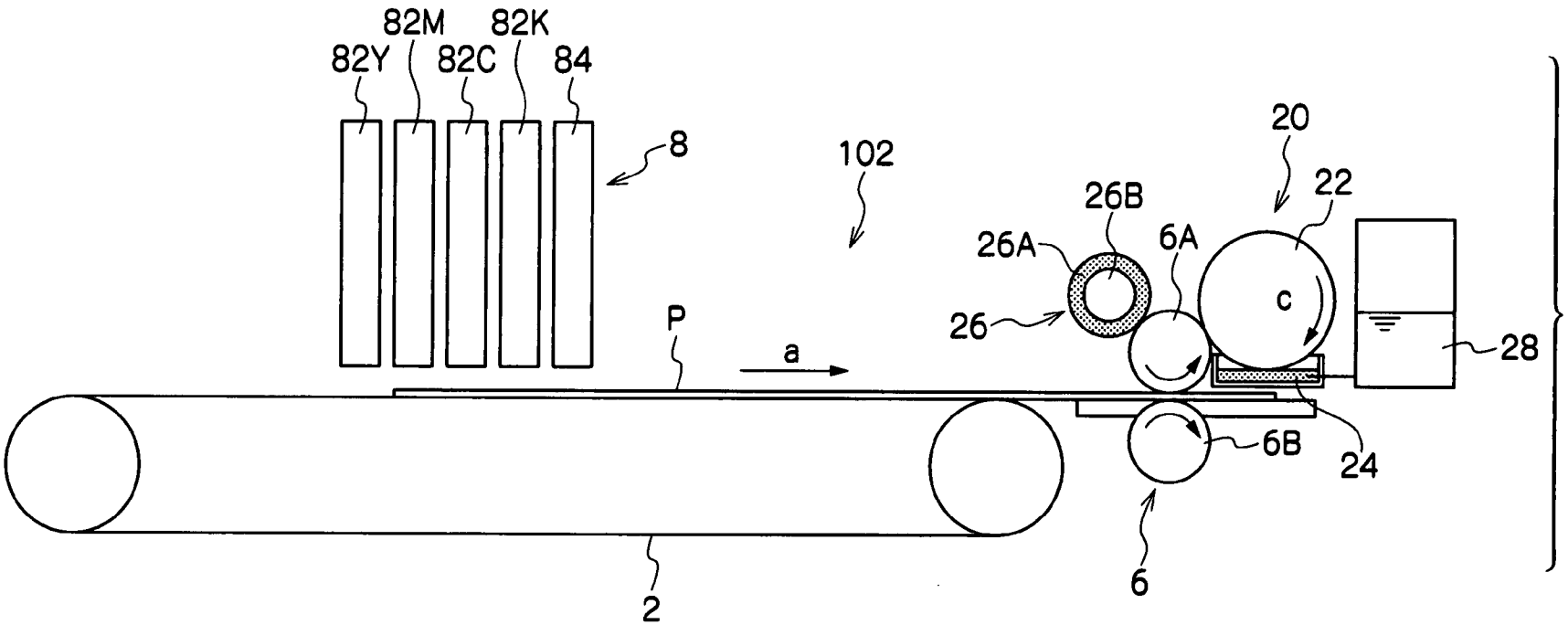
FIG. 3 is a schematic view showing a structure of an ink jet recording apparatus of a second embodiment.

As shown in FIG. 3, an ink jet recording apparatus 102 of a second embodiment includes a cleaning mechanism 20 cleaning the image side roller 6A in place of the wick 4 or the web driving mechanism 11 in the first embodiment.

As shown in FIG. 3, the cleaning mechanism 20 includes: a cleaning liquid applying roller 22 that is brought into contact with the image side roller 6A at a side opposite to the side that contacts with the paper P and rotates in an opposite direction to the image side roller 6A, as shown by an arrow 'c', so as to apply a cleaning liquid; a wick 24 that is positioned at an upstream side from the image side roller 6A with respect to the rotating direction 'c' of the cleaning liquid applying roller 22 and applies the cleaning liquid to the cleaning liquid applying roller 22; a wiping roller 26 which is positioned at a downstream side of the cleaning liquid applying roller 22 with respect to the rotating direction of the image side roller 6A; and a cleaning liquid reservoir layer 28 supplying the cleaning liquid to the wick 24. The cleaning liquid applying roller 22, the wick 24 and the cleaning liquid reservoir layer 28 correspond to a cleaning liquid applying portion in the droplet ejecting apparatus of the present invention, and the wiping roller 26 corresponds to a cleaning liquid wiping means in the droplet ejecting apparatus.

The cleaning liquid applying roller 22 includes a conventional metal or plastic roller having a smooth surface. The wiping roller 26 is constituted of a surface layer 26A formed of a porous material such as an unwoven fabric, cloth, felt, sponge or the like, which is the same as the porous material forming the wick 4 and the wick 18 as provided in the first embodiment, and a core 26B that is formed of rubber, plastic or the like and on which surface the surface layer 26A is formed.

Further, the wick 24 has the same constitution as that of the wick 4 and the wick 18 of the first embodiment.

As the cleaning liquid, in addition to a water solution of an anionic surface active agent or a cationic surface active agent, it is possible to use a nonionic surface active agent such as a polyethylene glycol, a polyethylene glycol-polypropylene glycol copolymer, an ethylene oxide-propylene oxide copolymer or the like having a molecular weight of about 1000 or less, and a water solution thereof. The nonionic surface active agent functions not only as a cleaning agent but an anti-contamination liquid. As an example of a composition of the anionic surface active agent water solution, a solution constituted of a Proxcel (trade name, antiseptic agent) 0.2 mass %, an ethanol (water-based solvent) 10 mass %, a sodium stearate (anionic surface active agent) 15 mass %, with water making up the balance can be mentioned.

A description will be given below of the operation of the ink jet recording apparatus 102.

As mentioned on the ink jet recording apparatus 100 of the first embodiment, when the paper P passes under the ink jet heads 82Y to 82B, a predetermined image is formed by the ink droplets discharged from the ink jet heads 82Y to 82B. The image formed on the upper surface of the paper P is made insoluble and fixed by the processing solution discharged from the processing solution head 84.

The paper P on which the image is fixed by the processing solution head 84 is conveyed out of the ink jet recording apparatus 102 by the carrier rollers 6; however, the image formed on the paper P contacts with the image side roller 6A.

In the cleaning mechanism 20, the cleaning liquid is applied to the cleaning liquid applying roller 22 by the wick 24. Further, after contacting with the paper P, the image side roller 6A contacts with the cleaning liquid applying roller 22 and the cleaning liquid is applied to the image side roller 6A. The cleaning liquid applied to the image side roller 6A is wiped off and removed by the wiping roller 26.

Accordingly, while wet ink on the paper P adheres onto the image side roller 6A, since the paper P is conveyed by the conveyance roller 6 before the image formed on the paper P is completely fixed, the ink on the image side roller 6A is removed by the cleaning mechanism 20 before the portion of the image side roller 6A to which the ink has adhered recontacts the paper P, and thus, ink adhering to the paper and the image being contaminated can be prevented.

Particularly since a nonionic surface active agent functions as a contaminant preventing liquid as well as a cleaning liquid, by using a nonionic surface active agent as the cleaning liquid, ink or other contamination does not adhere to the image side roller 6A.

3. Embodiment 3

An ink jet recording apparatus that can include the droplet ejecting apparatus of the present invention and that has a paper-reversing mechanism and is capable of double sided printing is described below.

Figure 4:
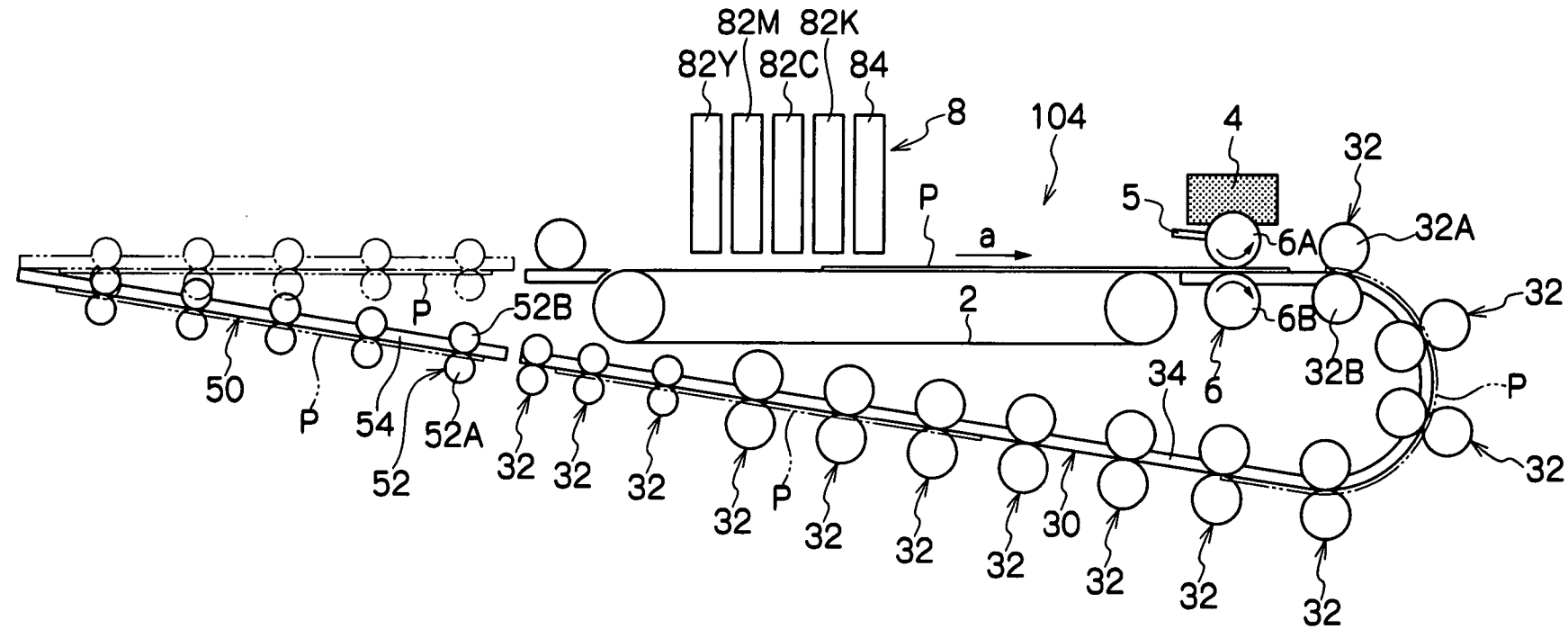
FIG. 4 is a schematic view showing a structure of an ink jet recording apparatus of a third embodiment.
Figure 5:
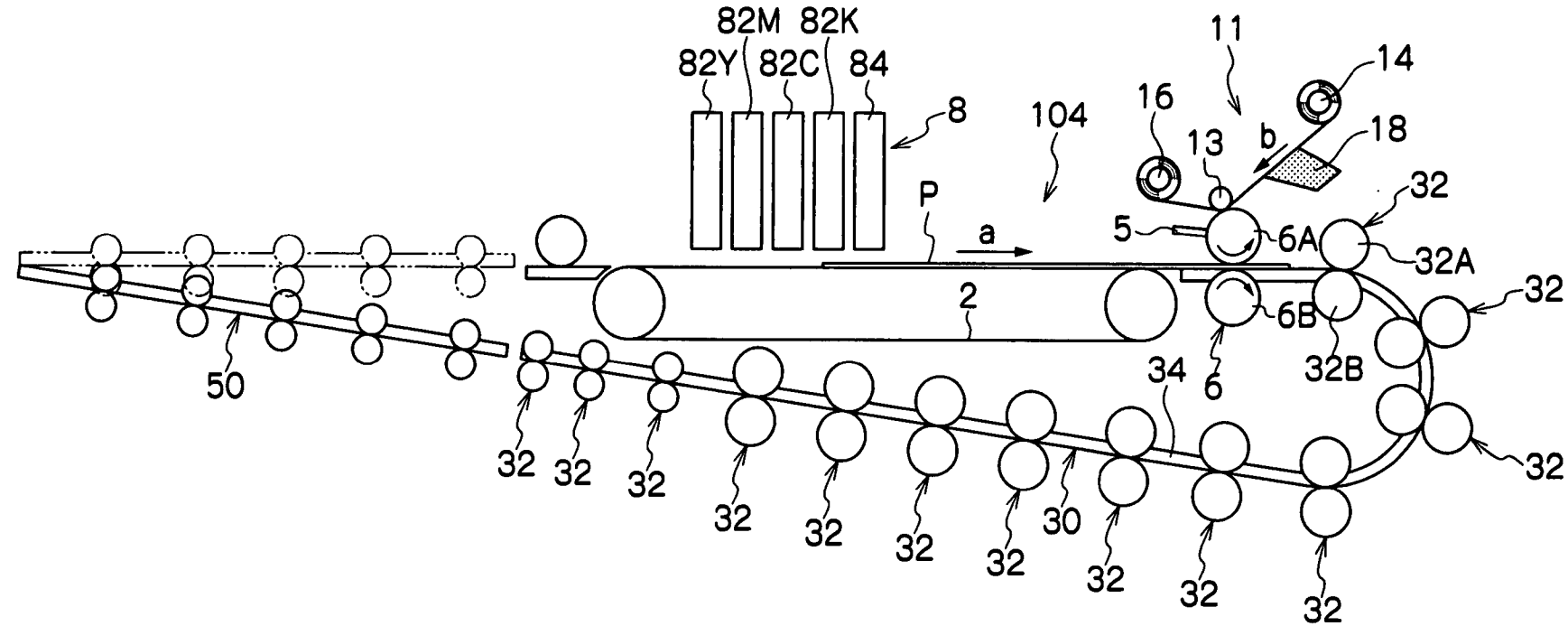
FIG. 5 is a schematic view showing a structure of another example of the ink jet recording apparatus of a third embodiment.

As shown in FIGS. 4 and 5, in an ink jet recording apparatus 104 of a third embodiment, a paper-reversing mechanism 30 is provided downstream from the carrier conveyor 2 with respect to the conveyance direction 'a' of the paper P, and a carrier path switching mechanism 50 is provided upstream of the carrier conveyor 2 with respect to the conveyance direction 'a' of the paper P. The carrier path switching mechanism 50 receives the paper reversed by the paper-reversing mechanism 30 and delivers the paper to the carrier conveyor 2.

The paper-reversing mechanism 30 includes a carrier plate 34 curved along an reversing path of the paper P, and a group of carrier rollers 32 provided so as to sandwich an outer surface of the carrier plate 34, that is, a paper conveyance path therebetween. The carrier rollers 32 include outer rollers 32A disposed outside of a paper-conveyance path along which the paper P is conveyed, and inner rollers 32B disposed inside of the paper conveyance path. The carrier rollers 6 are provided at an inlet portion of the paper-reversing mechanism 30. The paper P is pinched between the outer rollers 32A and the inner rollers 32B and is conveyed along the outer surface of the carrier plate 34.

The carrier path switching mechanism 50 includes a carrier plate 54 taking a first position that is shown in a solid line or a second position that is shown by a broken line in FIGS. 4 and 5, and a group of carrier rollers 52 provided so as to sandwich a lower surface of the carrier plate 54. The carrier rollers 52 include lower rollers 52A positioned at the lower side of the carrier plate 54 and upper rollers 52B positioned at the upper side thereof.

Except for the constitution mentioned above, the ink jet recording apparatus 104 has the same constitution as that of the ink jet recording apparatus 100 of the first embodiment.

The operation of the ink jet recording apparatus 104 is described below.

When the paper P is conveyed with respect to the conveyance direction 'a' by the carrier conveyor 2 and passes under the recording head array 8, a predetermined image is formed on the upper surface of the paper P by the respective color Y, M, C and B ink droplets discharged from the ink jet heads 82Y to 82B. The image formed on the upper surface of the paper P is made insoluble and fixed by the processing solution discharged from the processing solution head 84.

The paper P on which the image is fixed by the processing solution head 84 is conveyed to the paper-reversing mechanism 30 by the carrier rollers 6.

In the paper-reversing mechanism 30, the paper P is held by the carrier rollers 32 so that the printed surface thereof is positioned outside, and is conveyed toward the carrier path switching mechanism 50 along the outer surface of the carrier plate 34, that is, the paper conveyance path. Accordingly, the printed surface of the paper P that faces upward when the paper P is passing the recording head array 8 for the first time turns downward during the time when the paper P is conveyed through the paper-reversing mechanism 30.

The carrier path switching mechanism 50 is in a position shown in a solid line in FIGS. 4 and 5 during the time when the paper P is conveyed in the paper-reversing mechanism 30, and a lower surface of the carrier plate 54 forms a conveyance surface connected to the paper conveyance path of the carrier plate 34. Accordingly, as shown by a broken line in FIG. 4, the paper P conveyed in the paper-reversing mechanism 30 is held in the carrier path switching mechanism 50 so as to be pinched between the carrier plate 54 and the lower roller 52A with the printed surface thereof facing downward.

When the paper P is conveyed to the carrier path switching mechanism 50, the carrier plate 54 is moved to the position shown in the long dash two short dash line, and the lower surface of the carrier plate 54 forms a conveyance surface connected to the upper surface of the carrier conveyor 2. Then, the carrier rollers 52 rotate and deliver the paper P toward the carrier conveyor 2 with the printed surface thereof facing downward and the non-printed surface thereof facing upward.

The paper P delivered to the carrier conveyor 2 passes under the recording head array 8 with respect to the conveyance direction 'a' with the non-printed surface facing upward. Then, a second predetermined image is formed on the non-printed surface of the paper P by the color Y, M, C and B ink droplets discharged from the ink jet heads 82Y to 82B. The second image is made insoluble and fixed by the processing solution discharged from the processing solution head 84. Thus, images are formed on both surfaces of the paper P.

The paper P on which the second image is formed on the non-printed surface is conveyed out of the system by the carrier rollers 6.

Accordingly, the paper P contacts with the image side roller 6A twice, at a time when the paper P is delivered to the paper-reversing mechanism 30 and at a time when the paper P with images printed on both sides is discharged outside of the inkjet recording apparatus 104, at sides on which new images have been printed.

However, since the anti-contamination liquid is applied to the image side roller 6A by the wick 4 or the web driving mechanism 11, the wet ink on the paper P won't stick to the image side roller 6A, and thus, contamination of the images can be prevented.

Although an example has been described on of an inkjet recording apparatus 104 wherein the wick 4 or the web driving mechanism 11 is provided at the image side roller 6A of the conveyance rollers 6, the scope of the present embodiment is not limited to the above example. It is preferable that the wick 4 and the web driving mechanism 11 are provided at the outer rollers 32A in the carrier rollers 32, since then the wet ink does not adhere to the outer rollers 32A and contamination of the image on the paper P can be prevented even when the outer rollers 32A contact with the printed surface of the paper P at a time when the paper P is conveyed by the paper-reversing mechanism 30. The wick 4 or the web driving mechanism 11 may be provided only at the outer roller(s) 32A positioned at the inlet of the paper-reversing mechanism 30.

4. Embodiment 4

Described below is another example of an ink jet recording apparatus that can include the droplet ejecting apparatus of the present invention having a paper-reversing mechanism and capable of performing double side printing.

Figure 6:
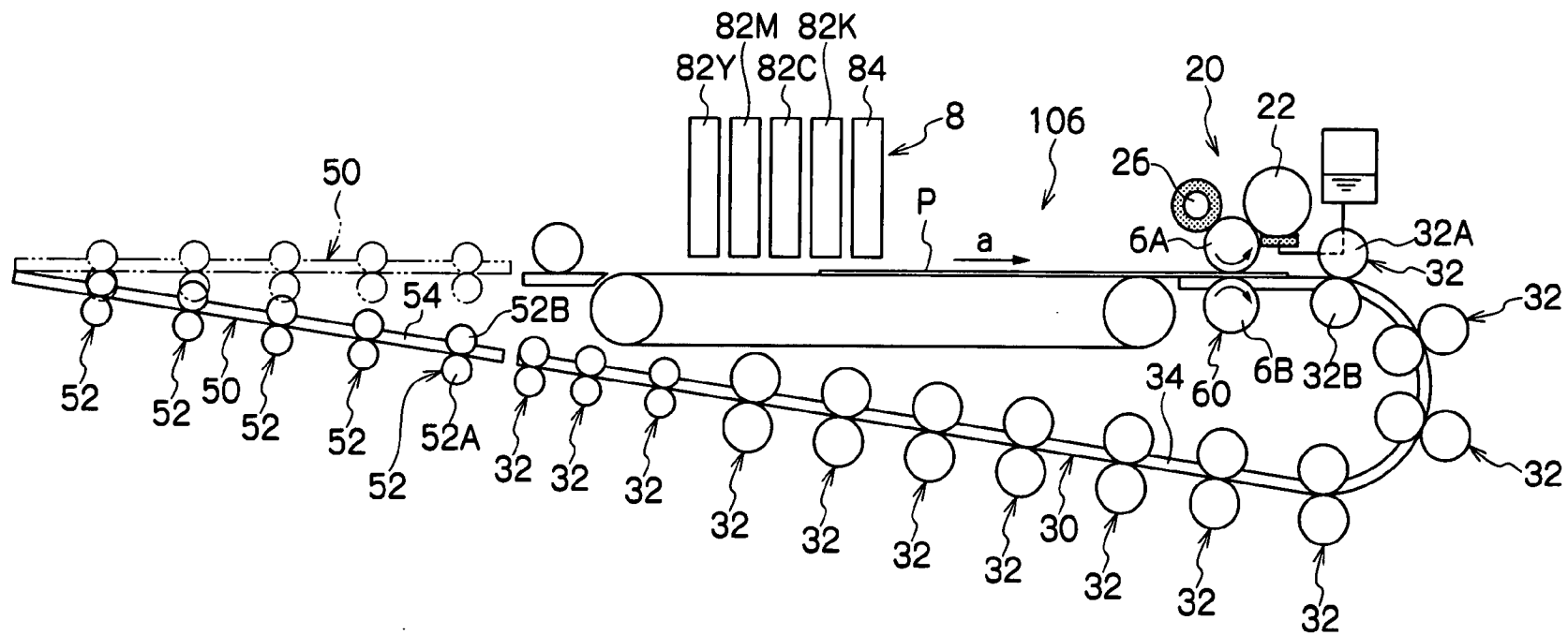
FIG. 6 is a schematic view showing a structure of an ink jet recording apparatus of a fourth embodiment.

As shown in FIG. 6, in an ink jet recording apparatus 106 of a fourth embodiment, the paper-reversing mechanism 30 is provided downstream from the carrier conveyor 2 with respect to the conveyance direction 'a' of the paper P, and a carrier path switching mechanism 50 is provided upstream of the carrier conveyor 2 with respect to the conveyance direction 'a' of the paper P. The carrier path switching mechanism 50 receives the paper reversed by the paper-reversing mechanism 30 and delivers the paper P to the carrier conveyor 2.

The construction and the operation of the paper-reversing mechanism 30 and the carrier path switching mechanism 50 are the same as described in the embodiment 3.

The ink jet recording apparatus 106 has the same constitution as that of the ink jet recording apparatus 102 of the second embodiment except for the point mentioned above.

Although the operation is the same as described in the embodiment 3, the inkjet recording apparatus of the present embodiment differs from the inkjet recording apparatus of the third embodiment in that the cleaning liquid is applied to the image side roller 6A by the cleaning mechanism 20, instead of applying an anti-contamination liquid thereto, and the cleaning liquid is then wiped off.

Although the cleaning mechanism 20 may simply be provided at the image side roller 6A of the carrier rollers 6, the cleaning mechanism 20 is preferably provided also at the outer rollers 32A in the paper-reversing mechanism 30, because the wet ink on the paper P will not then adhere to the outer rollers 32A and thus, contamination of the image on the paper P can be prevented.

In the above droplet ejecting apparatuses, since the droplet adherence preventing liquid is applied to the image side roller by the droplet adherence preventing liquid applying portion, droplets do not firmly adhere to the image side roller even when the recording medium is brought into contact with the recording medium carrier rollers when the droplets discharged from the droplet ejecting portion are not completely dried or fixed.

A second aspect of the present invention relates to the droplet ejecting apparatus of the first aspect, wherein the recording medium carrier rollers are arranged at a downstream side of the droplet ejecting portion with respect to a conveyance direction of the recording medium.

A third aspect of the present invention relates to the droplet ejecting apparatus of the first or second aspect, wherein the recording medium carrier rollers are arranged in a pair so as to nip the recording medium that is adhered to by droplets discharged from the droplet ejecting portion.

A fourth aspect of the present invention relates to the droplet ejecting apparatus of the third aspect, wherein the droplet adherence preventing liquid applying portion applies the droplet adherence preventing liquid to one of the recording medium carrier rollers brought into contact with the surface of the recording medium onto which the droplets are discharged.

A fifth of the present invention relates to the droplet ejecting apparatus of the fourth aspect, wherein the droplet adherence preventing liquid applying portion is provided with a droplet adherence preventing liquid applying member in which the droplet adherence preventing liquid is impregnated, the droplet adherence preventing liquid applying member being brought into contact with at least one recording medium carrier roller contacting with a surface of the recording medium to which droplets are discharged so as to apply the impregnated droplet adherence preventing liquid thereto.

In the above aspects of the droplet ejecting apparatus, the droplet adherence preventing liquid is applied to the roller among the recording medium carrier rollers located at the side onto which the droplets are discharged by contacting the droplet adherence preventing liquid applying member impregnated with the droplet adherence preventing liquid.

Accordingly, droplet adherence preventing liquid spattering and the periphery of the roller being contaminated can be prevented, and thus, droplet adherence preventing liquid can be applied with certainty to the image side roller.

Further, the application amount of the droplet adherence preventing liquid to the roller can be systematically controlled by controlling an amount of the droplet adherence preventing liquid supplied to the droplet adherence preventing liquid applying member.

In addition, when employing an droplet impregnated adherence preventing solution applying member in which the droplet adherence preventing solution is impregnated in advance, by replacing an impregnated droplet adherence preventing solution applying member, when the impregnated droplet adherence preventing solution has been consumed up or been contaminated by the removed droplets, with a new one, droplet removing capacity can be easily recovered.

Additionally, since the droplet adherence preventing liquid applying member is pressed against the roller at a certain degree of pressure, some friction is generated between the droplet adherence preventing liquid applying member and the print surface side roller(s).

Accordingly, the droplets adhering to the roller are effectively removed by the action of the droplet adherence preventing liquid and the friction therebetween.

Further, since it is sufficient that the droplet adherence preventing liquid applying portion simply applies the droplet adherence preventing liquid to the roller(s), it is not necessary to strongly press the droplet adherence preventing liquid applying portion against the roller. In addition, the droplet adherence preventing liquid applying portion is wetted by the droplet adherence preventing liquid.

Accordingly, since no excessive friction is generated between the droplet adherence preventing liquid applying portion and the image side roller, damage of the surface of the image roller caused by the friction between the droplet adherence preventing liquid applying portion and the image side roller can be effectively prevented.

As a material of the droplet adherence preventing liquid applying member, porous materials such as unwoven fabric, cloth, felt, sponge or the like can be mentioned. A tape formed of such porous materials can be included in the droplet adherence preventing liquid applying member. The tape is used in a droplet adherence preventing liquid applying mechanism for applying the droplet adherence preventing liquid to the image side roller. In the droplet adherence preventing liquid applying mechanism, the tape is wound into a roll. The tape is unwound from the roll and the droplet adherence preventing liquid is applied to the tape, then, the tape is brought into contact with the image side roller so as to apply the soaked liquid. After applying the droplet adherence preventing liquid, the tape is re-wound. Additionally, a droplet adherence preventing liquid applying roller having a surface formed of such porous materials can be included in the droplet adherence preventing liquid applying member. The droplet adherence preventing liquid can be applied by impregnating the surface of the droplet adherence preventing liquid applying roller with the droplet adherence preventing liquid and bringing the roller into contact with the image side roller.

A sixth aspect of the present invention relates to a droplet ejecting apparatus including: a recording medium carrier portion provided with a recording medium carrier roller and conveying a recording medium; a droplet ejecting portion discharging droplets to the recording medium; a cleaning liquid applying portion applying to at least one of the recording medium carrier rollers a cleaning liquid for removing droplets, or component(s) constituting the droplets, adhering to the recording medium carrier roller or a component constituting the droplets; and a cleaning liquid wiping means for wiping off the cleaning liquid applied to the recording medium carrier rollers.

In the droplet ejecting apparatus, since the cleaning liquid is applied to the recording medium carrier roller(s) by the cleaning liquid applying portion, and then the cleaning liquid is wiped off by the cleaning liquid wiping means, the droplets sticking to the recording medium carrier rollers are removed before the recording medium carrier rollers re-contact with the recording medium.

Since it is sufficient that the cleaning liquid applying portion simply applies the cleaning liquid to the recording medium carrier roller, the cleaning liquid applying portion is not needed to be pressed at a high pressure against the recording medium carrier roller. Further, since the cleaning liquid applying portion is soaked with the cleaning liquid, no excessive friction is generated between the cleaning liquid applying portion and the recording medium carrier roller(s).

Additionally, since it is sufficient that the cleaning liquid wiping means simply wipes off the cleaning liquid applied to the recording medium carrier roller, the cleaning liquid wiping means also need not be pressed at a high pressure against the recording medium carrier roller.

Accordingly, damage of the surface of the recording medium carrier rollers caused by the friction between the cleaning liquid applying portion and the cleaning liquid wiping means also can be effectively prevented.

A seventh aspect of the present invention relates to the droplet ejecting apparatus of the sixth aspect, wherein the recording medium carrier rollers are arranged at a downstream side of the droplet ejecting portion with respect to the conveyance direction of the recording medium.

An eighth aspect of the present invention relates to the droplet ejecting apparatus of the sixth or seventh aspect, wherein the recording medium carrier rollers are disposed in a pair so as to nip the recording medium adhered to with droplets discharged from the droplet ejecting portion.

A ninth aspect of the present invention relates to the droplet ejecting apparatus of the eighth aspect, wherein the cleaning liquid applying portion applies the cleaning liquid to one of the recording medium carrier rollers that is brought into contact with the surface of the recording medium onto which the droplets are discharged.

A tenth of the present invention relates to a droplet ejecting apparatus of the ninth aspect, wherein the cleaning liquid applying portion includes a cleaning liquid applying member in which the cleaning liquid is impregnated, the cleaning liquid applying member being brought into contact with one of the recording medium carrier rollers contacting with the surface of the recording medium onto which the droplets are discharged so as to apply the impregnated cleaning liquid.

In the droplet ejecting apparatus, the cleaning liquid is applied to a recording medium carrier roller located at the side onto which the droplets of the recording medium is discharged, by contacting the cleaning liquid applying member impregnated with the cleaning liquid with the roller.

Accordingly, the periphery of the roller being spattered with the cleaning liquid and contaminated can be prevented and thus, the cleaning liquid can be applied with certainty to the roller.

Further, it is possible to systematically control the applying amount of the cleaning liquid to the roller by controlling an amount of the cleaning liquid supplied to the cleaning liquid applying member.

In addition, by employing the cleaning liquid applying member previously impregnated with a predetermined amount of cleaning liquid, droplet removing capacity can be easily regenerated by replacing the cleaning liquid applying member with a new one when the impregnated cleaning liquid is used up.

As the cleaning liquid applying member, it is possible to employ the same porous materials as mentioned in the second aspect.

An eleventh aspect of the present invention relates to a droplet ejecting apparatus of any one of the sixth to tenth aspects, wherein the cleaning liquid also functions as droplet adherence preventing liquid preventing adherence of the droplets.

Since the cleaning liquid used in the droplet ejecting apparatus doubles as the droplet adherence preventing liquid, it is possible to prevent the droplets from re-adhering to the recording medium carrier roller(s) after the droplets are removed, owing to the small amount of remaining cleaning liquid on the recording medium carrier roller after the cleaning liquid has been wiped off.

A twelfth aspect of the present invention relates to a droplet ejecting apparatus of any one of the sixth to eleventh aspects, wherein the cleaning liquid includes at least a surface active agent.

Since the surface active agent is incorporated in the cleaning liquid used in the droplet ejecting apparatus, whether the droplets discharged from the droplet ejecting portion are aqueous or oil based, the droplets can be easily removed.

A thirteenth aspect of the present invention relates to a droplet adherence preventing method for preventing droplets from adhering to recording medium carrier rollers in a droplet ejecting apparatus having a recording medium carrier portion being provided with the recording medium carrier rollers and conveying a recording medium, and a droplet ejecting portion discharging droplets onto the recording medium conveyed by the recording medium carrier portion, includes: applying to at least one of the recording medium carrier rollers droplet adherence preventing liquid that prevents droplets from adhering.

In the droplet adherence preventing method, since the recording medium to which the droplets are discharged from the droplet ejecting portion is brought into contact with the recording medium carrier rollers after the droplet adherence preventing liquid is applied thereto, the droplets do not adhere to the recording medium carrier rollers even when the droplets on the recording medium is not completely dried or fixed.

A fourteenth aspect of the present invention relates to a droplet adherence preventing method of a recording medium carrier roller of the thirteenth aspect, wherein the droplet adherence preventing liquid is applied by bringing a droplet adherence preventing liquid applying member impregnated with the droplet adherence preventing liquid into contact with one of the recording medium carrier rollers.

In the droplet adherence preventing method, since the droplet adherence preventing liquid is applied to the recording medium carrier roller(s) by contacting the droplet adherence preventing liquid applying member impregnated with the droplet adherence preventing liquid with the recording medium carrier roller(s), the droplet adherence preventing liquid can be securely applied to the image side roller without being scattered to the periphery.

Further, it is possible to systematically control the applying amount of the droplet adherence preventing liquid to the recording medium carrier roller, by controlling the amount of the droplet adherence preventing liquid supplied to the droplet adherence preventing liquid applying member.

Further, since friction is generated between the droplet adherence preventing liquid applying member and the recording medium carrier roller(s), by the friction therebetween the droplets that stick to the recording medium carrier roller(s) can be removed.

In addition, by employing a droplet adherence preventing liquid applying member impregnated with a predetermined amount of droplet adherence preventing liquid in advance, for applying the droplet adherence preventing liquid to the recording medium carrier roller(s), when the droplet adherence preventing liquid in the droplet adherence preventing liquid applying member is used up or when the droplet adherence preventing liquid applying member is so contaminated by the removed droplets that sufficient droplet removing effect can not be achieved, droplet removing capacity can be easily recovered by replacing the old droplet adherence preventing liquid applying member with a new one.

As the droplet adherence preventing liquid applying member, the same porous materials as those mentioned in the second aspect can be used.

A fifteenth aspect of the present invention relates to a cleaning method of a recording medium carrier roller in droplet ejecting apparatus having a recording medium carrier portion provided with a recording medium carrier roller and conveying a recording medium, and droplet ejecting portion discharging droplets onto the recording medium conveyed by the recording medium carrier portion, including: applying a cleaning liquid to at least one of the recording medium carrier rollers for removing droplets, or component(s) constituting the droplets, adhering to the recording medium carrier roller; and wiping off the cleaning liquid applied to the recording medium carrier roller.

In the cleaning method, since the cleaning liquid is applied to the recording medium in the cleaning liquid applying step, and the cleaning liquid is next wiped off in the cleaning liquid wiping step, the droplets sticking to the recording medium carrier roller or the component constituting the droplets is removed before the next contact with the recording medium.

A sixteenth aspect of the present invention relates to the cleaning method for cleaning a recording medium carrier roller of the fifteenth aspect, wherein the cleaning liquid applying step applies the cleaning liquid by bringing a cleaning liquid applying member impregnated with the cleaning liquid into contact with at least one of the recording medium carrier rollers, and the cleaning liquid wiping step wipes off the cleaning liquid on the print surface side roller by a cleaning liquid wiping member.

In the cleaning method, since the cleaning liquid applying member is brought into contact with the print surface side roller at a time of applying the cleaning liquid, the cleaning liquid can be adhered to the recording medium carrier roller with certainty and without being scattered to the periphery, and the droplets in the roller surface of the recording medium carrier roller or the components constituting the droplets are not only removed by the operation of the cleaning liquid but also can be mechanically removed by the friction between the cleaning liquid applying member and the print surface side roller.

Since it is sufficient that the cleaning liquid applying member simply applies the cleaning liquid to the recording medium carrier roller, it is not necessary to strongly press the cleaning liquid applying member against the recording medium carrier roller. Further, the cleaning liquid applying portion is in a state wetted by the cleaning liquid.

Accordingly, it is possible to prevent the excessive friction from being generated between the print surface side roller and the cleaning liquid applying member and to prevent the print surface side roller from being worn.

Further, the cleaning liquid applied in the cleaning liquid applying step and droplets floating up from the recording medium carrier roller by the cleaning liquid are wiped off by the cleaning liquid wiping member in the next cleaning step so as to be removed.

As the cleaning liquid applying member and the cleaning liquid wiping member, it is possible to employ the porous material as mentioned in the second aspect. The porous material may be constituted as a tape or a belt. Further, it is possible to employ a cleaning liquid applying roller and a cleaning liquid wiping roller in which the surface is constituted by the porous material.

A seventeenth aspect of the present invention relates to a cleaning method of a recording medium carrier roller of the fifteenth or sixteenth aspect, wherein the cleaning liquid functions as a droplet adherence preventing liquid preventing adherence of droplets to the print surface side roller.

Since the cleaning liquid used in the cleaning method doubles as the droplet adherence preventing liquid, it is possible to prevent the droplets from re-adhering to the print surface side roller after the droplets are removed, owing to the small amount of remaining cleaning liquid on the recording medium carrier roller after being wiped off.

An eighteenth aspect of the present invention relates to a cleaning method of a recording medium carrier roller of any one of the fifteenth to seventeenth aspects, wherein the cleaning liquid includes at least one kind of surface active agent.

Since the surface active agent is included in the cleaning liquid used in the cleaning method, the droplets discharged from the droplet ejecting portion can be easily removed whether the droplets are water based or oil based.

The foregoing description of the embodiment of the present invention has been provided for the purpose of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet ejecting apparatus comprising:

a recording medium carrier portion provided with recording medium carrier rollers conveying a recording medium;

droplet ejecting portion discharging droplets onto the recording medium; and droplet adherence preventing liquid applying portion applying droplet adherence preventing liquid preventing adherence of the droplets to at least one of the recording medium carrier rollers, the droplet adherence preventing liquid comprising a zinc soap having a molecular weight of about 1,000 or less.

2. The droplet ejecting apparatus of claim 1, wherein the recording medium carrier rollers are arranged at a downstream side of the droplet ejecting portion with respect to a conveyance direction of the recording medium.

3. The droplet ejecting apparatus of claim 1, wherein the recording medium carrier rollers are arranged in a pair so as to nip the recording medium having droplets discharged from the droplet ejecting portion adhered thereto.

4. The droplet ejecting apparatus of claim 3, wherein the droplet adherence preventing liquid applying portion applies the droplet adherence preventing liquid to one of the recording medium carrier rollers that is brought into contact with the surface of the recording medium onto which the droplets are discharged.

5. The droplet ejecting apparatus of claim 4, wherein the droplet adherence preventing liquid applying portion comprises a droplet adherence preventing liquid applying member in which the droplet adherence preventing liquid is impregnated, the droplet adherence preventing liquid applying member being brought into contact with at least one recording medium carrier roller contacting a surface of the recording medium to which droplets are discharged so as to apply the droplet adherence preventing liquid thereto.

* * * * *